US005125478A

United States Patent [19]

Henningsen

[11] Patent Number: 5,125,478

[45] Date of Patent: Jun. 30, 1992

[54] FOLDING SAWHORSE

[76] Inventor: Ralph J. Henningsen, 50 Sparkes Rd., Sebastopol, Calif. 95472

[21] Appl. No.: 655,662

[22] Filed: Feb. 14, 1991

[51] Int. Cl.[5] ..... E06C 1/00

[52] U.S. Cl. ..... 182/155; 182/255

[58] Field of Search ..... 248/165; 182/181, 186, 182/155, 225

[56] References Cited

U.S. PATENT DOCUMENTS

| | | | |
|---|---|---|---|
| 1,450,869 | 4/1923 | Reinelt | 182/186 |
| 1,846,144 | 1/1932 | Risbridger et al. | 182/155 |
| 2,594,464 | 4/1952 | Loucks, Jr. | 182/155 |
| 2,689,154 | 9/1954 | Redler | 182/186 |
| 2,816,805 | 12/1957 | Vaughn | 182/181 |
| 2,854,290 | 9/1958 | Steen | 182/181 X |
| 2,973,053 | 2/1961 | Beaty | 182/155 |
| 3,446,312 | 5/1969 | Jones | 182/186 X |
| 3,716,112 | 2/1973 | Lake | 182/155 |
| 4,278,148 | 7/1981 | Daley et al. | 182/181 |
| 4,967,877 | 11/1990 | Wallman et al. | 182/155 |

FOREIGN PATENT DOCUMENTS

| | | | |
|---|---|---|---|
| 1218135 | 6/1966 | Fed. Rep. of Germany | 182/155 |
| 2038172 | 7/1980 | United Kingdom | 182/155 |

*Primary Examiner*—David L. Talbott
*Attorney, Agent, or Firm*—Larry D. Johnson

[57] ABSTRACT

A folding sawhorse includes a pair of opposing leg assemblies each pivotally attached to a lateral connecting member. When the leg assemblies are pivoted and extended into their erected configuration, the uppermost portions of the leg assemblies define a slot portion for releasable capture of a nominally sized board to be used as a working surface. When such board is removed, the leg assemblies may be pivoted and retracted to their collapsed configuration, such that the lateral connecting member now occupies the leg assembly slot portions, and the device is nearly planar in cross section.

3 Claims, 5 Drawing Sheets

FOLDING SAWHORSE

BACKGROUND OF THE INVENTION

1. Field of the Invention

This invention relates generally to construction equipment and related hardware, and more specifically to an improved folding sawhorse device.

2. Description of the Prior Art

The purpose of a sawhorse is to provide a relatively portable and stable work platform and base support for cutting, drilling, and the like. Builders, contractors, and handymen of all sorts use sawhorses frequently. Most often the sawhorses are built as a single unitary structure, made of wood that after a period of time becomes unstable and requires replacement. In addition, such fixed sawhorses are bulky and difficult to store and transport.

Several designs of folding sawhorses have been developed. One design has folding legs that clamp onto a crosspiece when the legs are extended for use. The disadvantage of this design is that it is composed of separate pieces, and will fail if the cross piece fails. Another known design provides a collapsible metal framework used to support a user-provided wooden working surface. However, such designs require a relatively large number of mechanical or moving components (which adds to complexity and are prone to breakage), and do not readily allow for various height adjustments.

SUMMARY OF THE INVENTION

The folding sawhorse of this invention comprises a pair of opposing leg assemblies each pivotally attached to a lateral connecting member. When the leg assemblies are pivoted and extended into their erected configuration, the uppermost portions of the leg assemblies define a slot portion for releasable capture of a nominally sized board to be used as a working surface. When such board is removed, the leg assemblies may be pivoted and retracted to their collapsed configuration, such that the lateral connecting member now occupies the leg assembly slot portions, and the device is nearly planar in cross section.

In the preferred embodiment, the folding sawhorse of this invention is constructed of square steel tubing and is designed to receive a two by four, two by six, or other two inch nominal wood member for the work support surface. The legs are made of one inch square tubing and assembled in the shape of an "A" with an open slot at the top of the "A". These leg assemblies are welded pieces providing one set of legs for each end of the sawhorse.

The horizontal member that connects the two pair of legs is a single straight piece of one and half inch square steel tubing. The bolts that secure the legs to the horizontal member are of grade 8 hardness. The bolts allow the legs to rotate on the horizontal member to fold flat for storage, or open with legs extended downward when set up in the use position. The leg rotation is limited by the position of one of the cross bars that connect the leg assemblies. The legs rotate downward and away from the center of the horizontal member to provide maximum stability in the use position.

When open and in the use position, the topmost portion of the "A" frame legs are disposed above the horizontal member. The part of the leg frame that is so disposed at each end of the sawhorse creates a slot to receive a board of nominal size (two by four, two by six, etc.) which is the working surface of the sawhorse. The board is secured there by set screws. When the screws are set, the whole unit is locked and ready for use. The working surface height is thus adjusted by the width of the lumber inserted in the slot.

The ability to adjust the height of a sawhorse can be significant. Height requirements can vary according to use. The original design of a sawhorse allowed a person using a handsaw to use a comfortable downward thrust for cutting and to use their knee to hold down and secure the material being cut. The surface for cutting with hand power saws can be slightly higher with one arm holding down the material and one arm operating the saw. The operator is in a much more upright position for better balance and comfort. The surface for planing, routing and sanding should be slightly higher still to allow for better control and balance in the stroking kind of activity that these tasks involve. Many assembly and other work bench activities are best accomplished at an even higher work surface. The folding sawhorse of this invention enables the user to quickly adjust to the various height needs by simply exchanging the nominal size board used as a cross rail. As such, this folding sawhorse is a versatile support system adaptable to many uses.

Thus, the folding sawhorse of this invention provides a sawhorse that is reliable, safe, strong and easy to set up. It can vary in working surface height requirements and is convenient to store and transport.

DETAILED DESCRIPTION OF A PREFERRED EMBODIMENT

Figure 1:
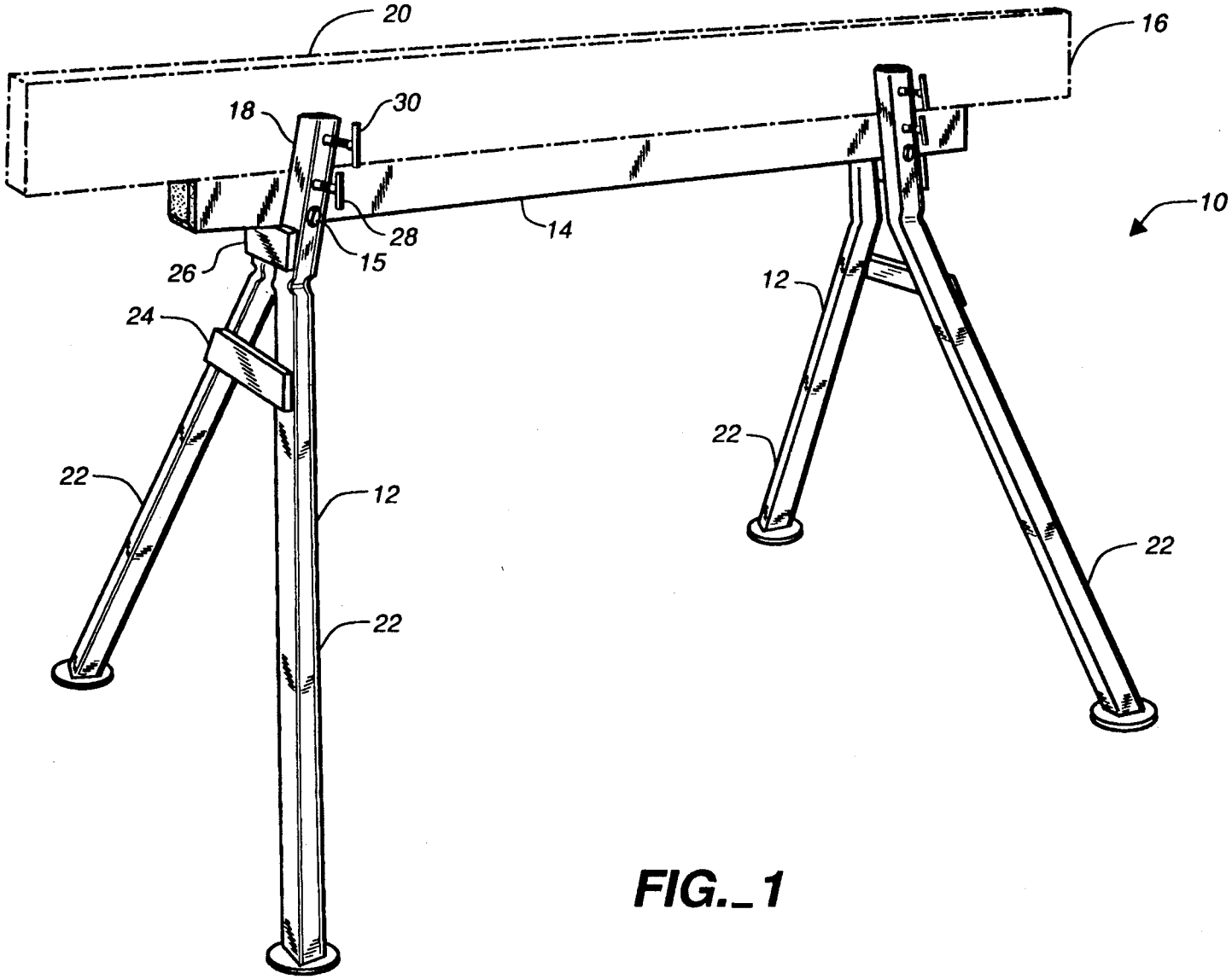
FIG. 1 is a perspective view of the folding sawhorse of this invention in its erected configuration, illustrating a pair of opposing leg assemblies and a lateral connecting member, with a section of nominal size board secured within the leg assembly slot portions and upon the lateral connecting member for use as a working surface.

FIG. 1 is a perspective view of the folding sawhorse 10 of this invention in its erected configuration, illustrating a pair of opposing leg assemblies 12 and a lateral connecting member 14, with a section of nominal size board 16 secured within the leg assembly slot portions 18 and upon the lateral connecting member 14 for use as a working surface 20. Leg assemblies 12 each include a pair of leg elements 22, a leg cross bar 24 for strength and to limit the collapsed folding (illustrated infra), and supporting cross bars 26 which support the lateral connecting member 14 and limit the erected extension of the leg assemblies. Leg assemblies 12 are pivotally connected to lateral connecting member 14 by bolt or shaft 15. Leg assembly locking set screws 28 secure the leg assemblies in both the erected and collapsed configurations, while working surface locking set screws 30 secure the board 16 in leg assembly slot portions 18.

Figure 2:
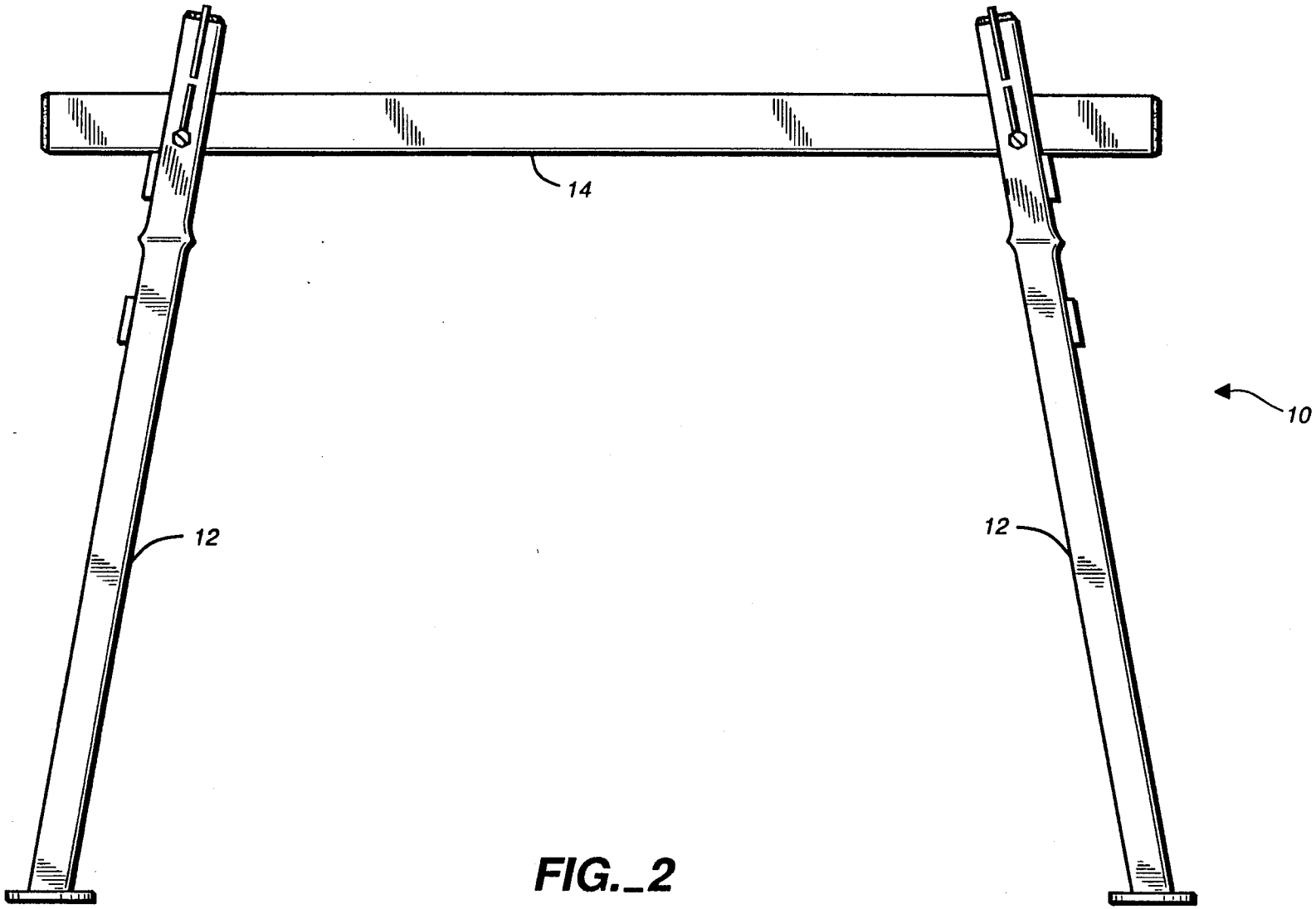
FIG. 2 is a side elevation view of the folding sawhorse of this invention in its erected configuration.

FIG. 2 is a side elevation view of the folding sawhorse 10 of this invention in its erected configuration. This view illustrates the preferred slight (e.g., ten to fifteen degrees beyond normal) outward extension of the leg assemblies 12 relative to lateral connecting member 14.

Figure 3:
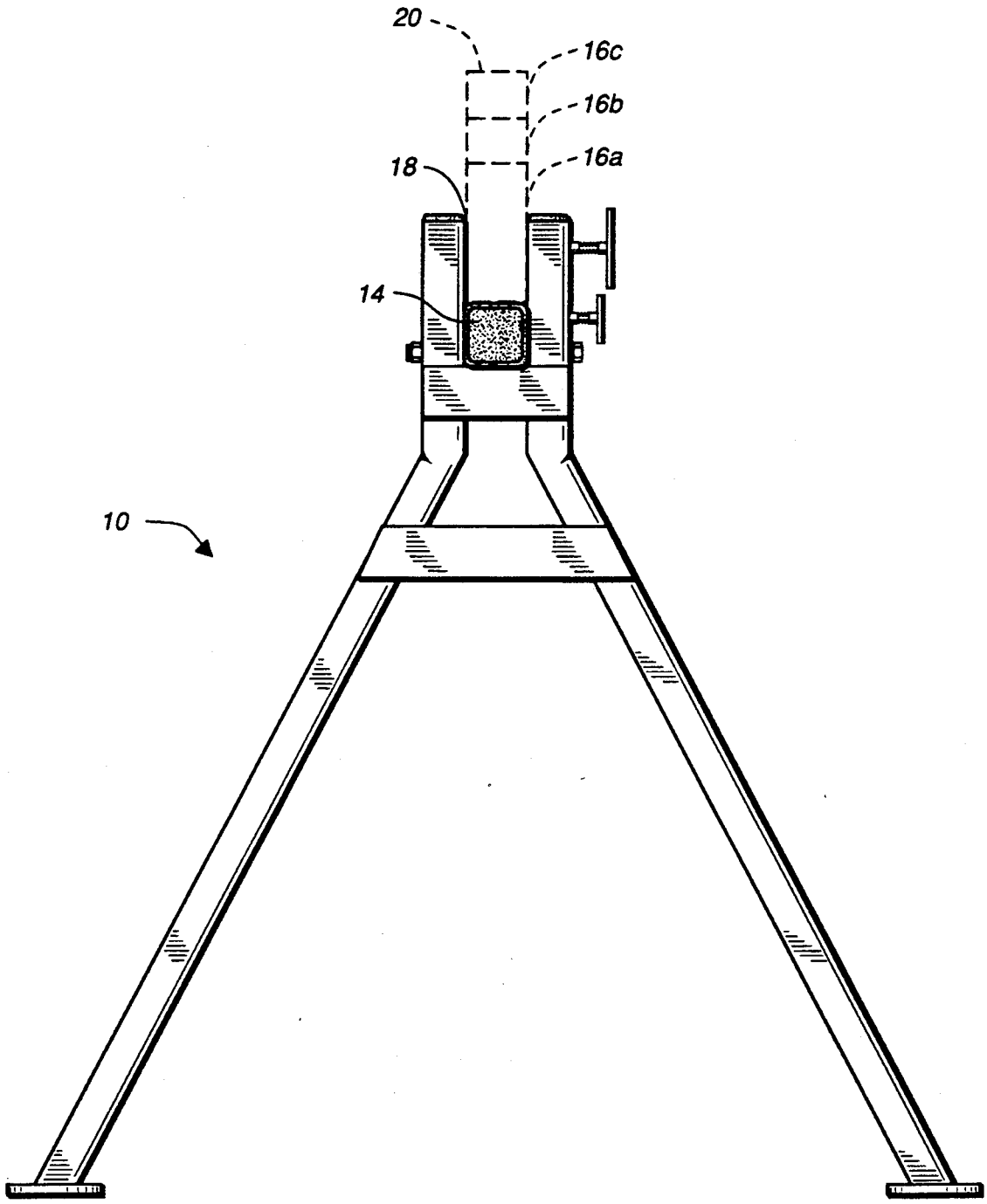
FIG. 3 is an end elevation view of the folding sawhorse of this invention in its erected configuration, illustrating (in phantom) a variety of dimensions of nominal size boards as secured within the leg assembly slot portions and upon the lateral connecting member for use as a working surface, thereby adjusting the height of the working surface.

FIG. 3 is an end elevation view of the folding sawhorse 10 of this invention in its erected configuration, illustrating (in phantom) a variety of dimensions of nominal size boards 16*a*, b, c as secured within the leg assembly slot portions 18 and upon the lateral connecting member 14 for use as a working surface, thereby adjusting the height of the working surface 20. For example, board 16*a* of nominal size two inches by four inches would yield the lowest position for use with hand saws, as a scaffold support, or the like. Board 16*b* of nominal size two inches by six inches yields a slightly higher position that is more comfortable for hand powered saws, while board 16*c* of nominal size two inches by eight inches yield a suitable height for hand power planers, sanders, and the like.

Figure 4:
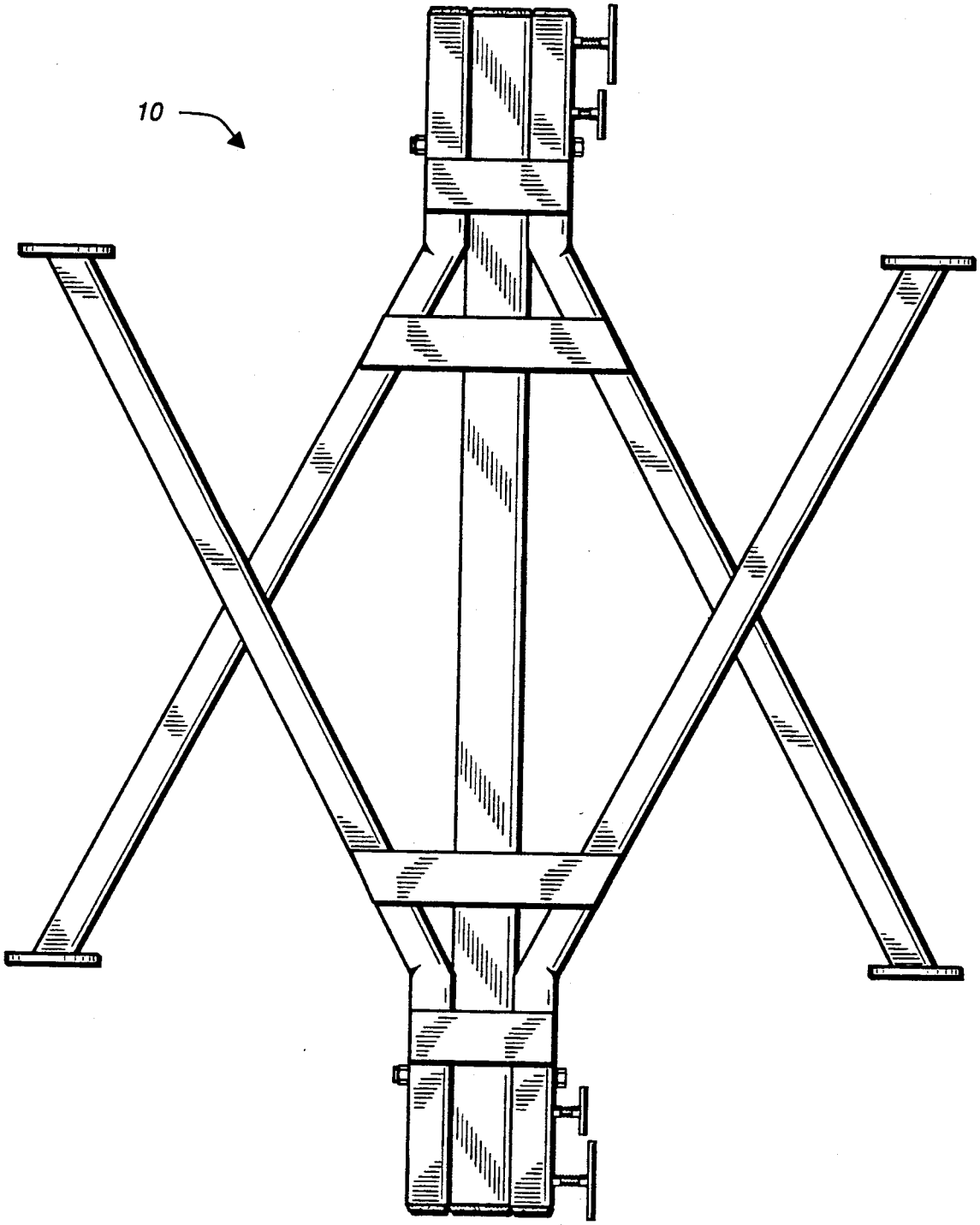
FIG. 4 is a bottom plan view of the folding sawhorse of this invention in its collapsed configuration.
Figure 5:
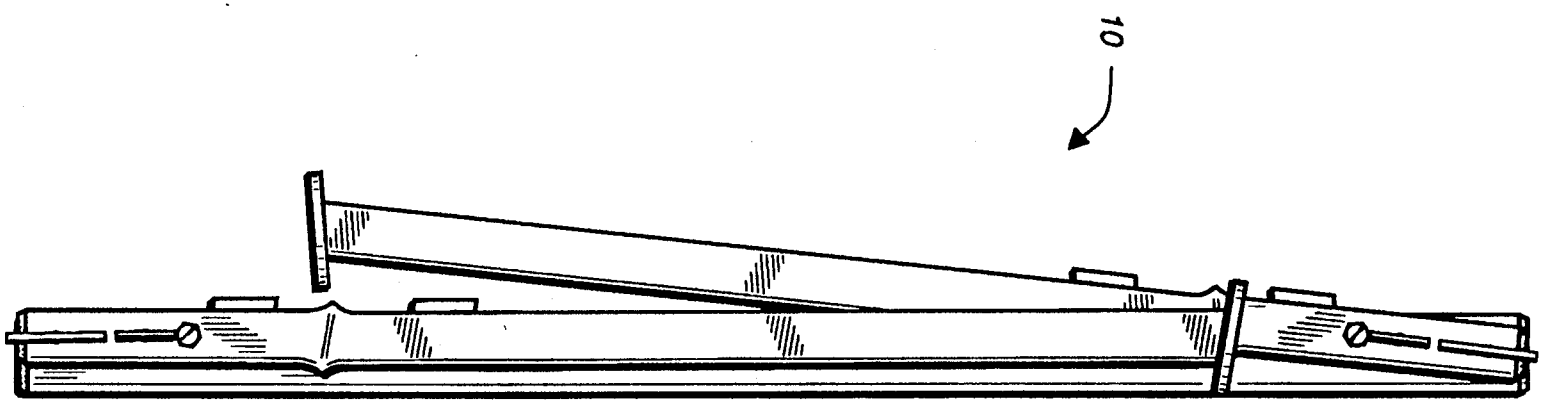
FIG. 5 is a side elevation view of the folding sawhorse of this invention in its collapsed configuration.

FIG. 4 is a bottom plan view of the folding sawhorse 10 of this invention in its collapsed configuration, while FIG. 5 is a side elevation view of the folding sawhorse of this invention in its collapsed configuration. This collapsed configuration is appropriate for transport and storage.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A folding sawhorse for attachment to a board for creation of a working surface, said folding sawhorse having an erected configuration and a collapsed configuration, said folding sawhorse comprising:

a lateral connecting member having a pair of ends; and a pair of opposing leg assemblies each comprising a pair of leg elements, said leg assemblies pivotally attached to said lateral connecting member proximate said ends, each of said leg assemblies including a crossbar to support said lateral connecting member and limit the extension of said leg assemblies in said erected configuration, each of said leg assemblies carrying uppermost slot portions conditioned for releasable capture of said board when said folding sawhorse is in said erected configuration, and further conditioned for acceptance of said lateral connecting member when said folding sawhorse is in said collapsed configuration, said slot portions including first locking means for securing said lateral connecting member in a fixed position relative to said leg assemblies in either said erected configuration or said collapsed configuration, and second locking means for securing said board in a fixed position relative to said leg assemblies when said folding sawhorse is in said erected configuration.

2. The folding sawhorse of claim 1 wherein said first locking means comprises a set screw.

3. The folding sawhorse of claim 1 wherein said second locking means comprises a set screw.

* * * * *